US008910345B2

(12) United States Patent
Bland et al.

(10) Patent No.: US 8,910,345 B2
(45) Date of Patent: Dec. 16, 2014

(54) DOOR CLOSER

(75) Inventors: Timothy Bland, Malvern (GB); James Frost, Stourbridge (GB); David Williams, Gornalwood Dudley (GB); Lee Melville, Warwick (GB)

(73) Assignee: Ingersoll Rand Security Technologies Limited, West Midlands (GB)

( * ) Notice: Subject to any disclaimer, the term of this patent is extended or adjusted under 35 U.S.C. 154(b) by 192 days.

(21) Appl. No.: 13/497,713

(22) PCT Filed: Sep. 23, 2010

(86) PCT No.: PCT/GB2010/001795

§ 371 (c)(1), (2), (4) Date: Dec. 28, 2012

(87) PCT Pub. No.: WO2011/036456

PCT Pub. Date: Mar. 31, 2011

(65) Prior Publication Data

US 2013/0097805 A1 Apr. 25, 2013

(30) Foreign Application Priority Data

Sep. 24, 2009 (GB) ..... 0916768.5

(51) Int. Cl.

| | |
|---|---|
| ***E05F 1/00*** | (2006.01) |
| ***E05F 3/10*** | (2006.01) |
| ***E05F 1/10*** | (2006.01) |
| ***E05F 15/18*** | (2006.01) |
| *E05F 3/22* | (2006.01) |

(52) U.S. Cl.

CPC ..... *E05F 1/105* (2013.01); *E05F 3/104* (2013.01); *E05F 1/00* (2013.01); *E05F 15/18* (2013.01); *E05Y 2201/46* (2013.01); *E05Y 2201/412* (2013.01); *E05Y 2900/132* (2013.01); *E05F 3/227* (2013.01)

USPC ..... 16/72; 16/71

(58) Field of Classification Search

USPC ..... 16/72, 76, 49, 54, 53, 60, 68, 50, 320, 16/378

See application file for complete search history.

(56) References Cited

U.S. PATENT DOCUMENTS

| | | | | |
|---|---|---|---|---|
| 3,771,195 A | | 11/1973 | Tansley | |
| 3,838,477 A | * | 10/1974 | Evans et al. | 16/55 |
| 4,064,589 A | * | 12/1977 | Bejarano et al. | 16/53 |

(Continued)

FOREIGN PATENT DOCUMENTS

| | | |
|---|---|---|
| DE | 10031403 A1 | 1/2002 |
| EP | 1329581 A2 | 7/2003 |

(Continued)

*Primary Examiner* — Chuck Mah

(74) *Attorney, Agent, or Firm* — Michael Best & Friedrich LLP

(57) ABSTRACT

A door closer has a housing for connection to a door and a drive spindle (10) coupled to the door. As the door moves the spindle (10) and housing (11) rotate relative to one another. The relative movement is translated by a piston and cam mechanism (21, 22) into a force that is used to separate a pair of magnets (28). The magnetic attraction of the magnet pairs (28) serves as a force to resist opening of the door and biases the door from an open to a closed position. At least one first magnet is coupled to the drive member and at least one second magnet (32) coupled to the housing. The magnets are arranged in the housing with their opposite poles facing one another such that there is a magnetic force of attraction between them. At least one further biasing spring (36) may be provided to provide a biasing force after the magnetic force has diminished by separation of the magnets.

9 Claims, 4 Drawing Sheets

(56) References Cited

U.S. PATENT DOCUMENTS

| | | | | |
|---|---|---|---|---|
| 4,506,407 | A * | 3/1985 | Downey | 16/48.5 |
| 4,663,800 | A * | 5/1987 | Mettenleiter et al. | 16/51 |
| 4,995,658 | A * | 2/1991 | Shiraki et al. | 292/336.3 |
| 5,592,780 | A * | 1/1997 | Checkovich | 49/386 |
| 6,167,589 | B1 | 1/2001 | Luedtke | |
| 6,823,561 | B2 * | 11/2004 | Park et al. | 16/320 |
| 2004/0134732 | A1 | 7/2004 | Mintgen et al. | |

FOREIGN PATENT DOCUMENTS

| | | | |
|---|---|---|---|
| FR | 1373516 | A | 9/1964 |
| KR | 2005034097 | A * | 4/2005 |

* cited by examiner

DOOR CLOSER

CROSS-REFERENCE TO RELATED APPLICATIONS

This application is a national phase application of PCT Application No. PCT/GB2010/001795, filed Sep. 23, 2010, which claims priority to United Kingdom Patent Application No. 0916768.5, filed Sep. 24, 2009, the entire contents of which are both hereby incorporated by reference herein.

BACKGROUND

The present invention relates to a door closer of the kind that is used to control the movement of a door from an open position to a closed position.

Door closers are conventionally fitted to a door or a door frame and generally comprise a mechanism for storing energy which is typically in the form of a spring. Energy is stored by the spring during opening of the door and is released to effect automatic closure of the door.

In one common type of door closer a rotary spindle for coupling to the door rotates with opening movement of the door. The spindle is coupled a transmission mechanism that converts the rotational movement into rectilinear reciprocation of a piston in a first direction within an elongate door closer housing. The spring biases the piston in an opposite second direction to urge the door to the closed position and the speed of movement of the door between the open and closed positions is controlled by the flow of hydraulic fluid from one side of the piston to the other via passages for the restricted flow of fluid. In one example the transmission mechanism is a pinion that rotates with the spindle and drives a rack in translation, the rack being connected to the piston. In other example, a cam is coupled to the spindle and acts directly or indirectly on part of the piston.

Door closers of the kind described require the spring to apply a predetermined force that is relatively high to resist opening of the door so as to meet fire regulations. Once the initial opening travel of the door is complete the resisting force need not be so high. At the end of the opening movement it is desirable to have a slight rise in the force to give a detent feeling for the user.

A conventional spring has a linear spring force characteristic during compression as indicated in FIG. 1. The spring stress is increased as the door opens to deliver the high forces and this can lead to premature spring failure. Mechanisms such as a cam or kinematic linkage are usually incorporated into the closer to achieve modify the force such that it more closely approximates to a desired force profile. The introduction of such a mechanism reduces the overall efficiency of the closer and therefore larger spring forces are necessary to achieve the desired output force. This generally means that larger springs and mechanisms have to be accommodated and the door closer housing is correspondingly large.

It is one object of the present invention to obviate or mitigate at least one of the aforesaid disadvantages. It is also an object of the present invention to provide for an improved or alternative door closer.

According to a first aspect of the present invention there is provided a door closer for coupling to a door comprising a housing and a drive member disposed in the housing for movement relative to the housing as the door moves between open and closed positions, at least one first magnetic means coupled to the drive member, at least one second magnetic means coupled to the housing, the at least one first and second magnetic means arranged in the housing with their opposite poles facing one another such that there is a magnetic force of attraction between them, whereby relative movement of the housing and the drive member effects relative movement of the at least one first and second magnetic means between proximal and distal positions, the at least one first and second magnetic means being biased to the proximal position by the magnetic force of attraction, at least one of the first and second magnetic means being a permanent magnet.

In use the magnetic force of attraction is exploited to provide a force that biases the door to the closed position. By using magnets this force can be relatively high for a short distance of movement of the door and the magnets, the force dropping off relatively rapidly as the magnets move to the distal position. The force also operates to provide a resistance to opening of the door.

The magnetic means may be a permanent magnet, an electromagnet or a magnetic material (such as, for example, a ferromagnetic material) that defines a pole piece for attraction to an opposite magnetic pole.

The door closer mechanism is thus simple and compact allowing it to be fitted into relatively confined spaces, particularly as large springs are not required to apply the large forced required to generate the large torque required to close the door. In particular it may be concealed in a rebate in the door or door frame.

SUMMARY

Depending on how the door closer, door and door frame are connected the drive member may rotate in a fixed housing or the housing may rotate with the door about a fixed drive member. For example, the housing of the door closer may be disposed in or on the door, in or on the door frame, or in the floor over which the door passes.

The drive member may be of any convenient form. It may for example be disposed in the housing for rotation about an axis. It may be in the form of a spindle.

The relative movement of the drive member and the housing is translated by any suitable mechanism into a movement for separating the at least one first and second magnetic means. Similarly, when the magnetic means are not in the proximal position the magnetic force of attraction biases them towards the proximal position and any such movement in that direction is translated by the mechanism into relative rotation of the drive member and the housing. The mechanism could, for example, be a piston and cam arrangement.

The at least one first magnetic means may be coupled (directly or indirectly) to the drive member by a piston and cam arrangement. The piston may be reciprocally disposed in the housing. It may be moveable in the housing in a rectilinear path. The cam may be coupled to the drive member. For example it may be mounted on the drive member for rotation therewith. It may indeed be integrally formed with the drive member. It preferably defines a cam surface for engagement, directly or indirectly, with the piston so as to effect reciprocal movement of the piston as the cam surface rotates about the axis. The cam may be connected to the drive member so that it rotates therewith about the axis. The piston may be a cam follower and may have a cam surface for interaction with the surface of the cam. The cam may be eccentrically mounted on the rotational axis of the drive member.

The at least one first magnetic means may be supported by the piston such that it reciprocates therewith. In particular it may be received in a pocket or other cavity in the piston.

The piston may define an opening in which at the least one second magnetic means is received. The piston may be arranged to reciprocate such that the opening moves relative to the at least one second magnetic means (which is fixed relative to the housing).

There may be provided at least one first biasing member, such as for example a compression spring, for further biasing the at least one first and second magnetic means towards the proximal position. The at least one first biasing member provides a biasing force that dominates once the magnetic force of attraction has diminished by virtue of the at least one first and second magnetic means have been displaced towards the distal position.

The at least one first biasing member may be arranged to bias the piston towards the cam. It may be disposed between a fixed wall of the housing and the piston. The fixed wall may form part of a housing in which the at least one second magnetic means is received.

The at least one second magnetic means may be received in a magnet housing that is fixed relative to the housing of the door closer.

At least one second biasing member may be provided that applies a biasing force to the piston when the at least one first and second magnetic means approach the distal position. It may be disposed between an end wall of the housing and the piston.

The first and second magnetic means may both be permanent magnets.

BRIEF DESCRIPTION OF THE DRAWINGS

A specific embodiment of the present invention will now be described, by way of example only, with reference to the accompanying drawings in which.

DETAILED DESCRIPTION

Figure 1:
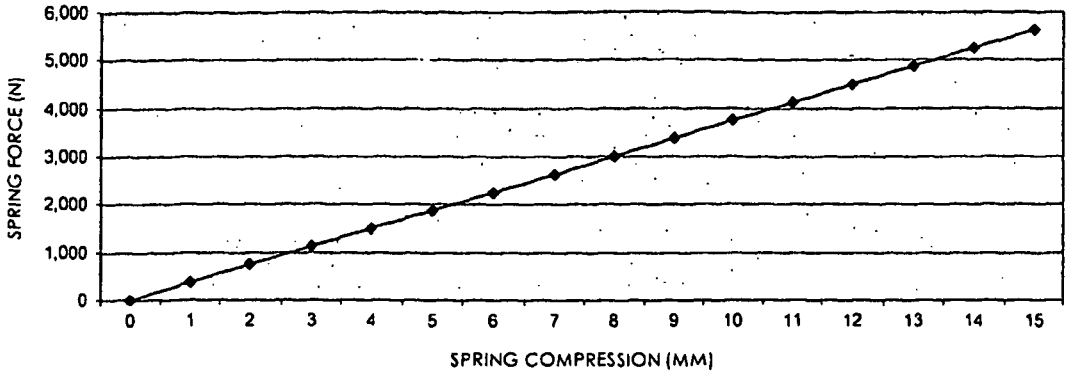
FIG. 1 is a graph illustrating a conventional compression spring force.

Referring now to FIGS. 2 to 5, the exemplary door closer has a drive spindle 10 supported in a housing 11 for rotation about its central longitudinal axis 20. In use, the housing 11 is typically fixed to a door and the spindle 10 is coupled to a door frame in such a manner that the spindle 10 rotates in the housing 11 as the door moves between open and closed positions relative to the door frame. Alternatively the housing 11 may be fixed to the door frame and the spindle 10 coupled to the door.

The housing 11 is elongate with parallel side walls 13, upper and lower walls 14, 15 and end walls 16, 17 that combine to define an outer chamber 18. The drive spindle 10 is rotatably mounted in the housing 11 at one end adjacent to end wall 16 and has a first end 19 that projects out of the housing 11 for coupling to the door or door frame. The drive spindle 10 rotates about its longitudinal central axis 20 and has an integral eccentric cam 21 that bears against a cam follower 22 slidably disposed for translation in the outer chamber 18 of the housing 11 in a direction perpendicular to the axis 20 of the spindle 10.

The cam follower 22 has a pair of side walls 23, the walls being arranged substantially parallel to the side walls 13 of the housing 11, and end walls 24, 25. A first end wall 24 is adjacent to the eccentric cam 21 and has a cam surface 26 defined thereon for interaction with the surface of the cam 21. A second end wall 25, opposite the first end wall 24, defines a pair of pockets 27 in which a first pair of magnets 28 are received in vertical array. The walls 23, 24 and 25 combine to define an inner chamber 29 in which is received a fixed magnet housing 30 having a pair of pockets 31 opposite those pockets 27 in the second end wall 25 for receipt of a second pair of magnets 32. The fixed magnet housing 30 has a pair of side walls 33 inboard of, and substantially parallel to, the side walls 23 of the cam follower 22 and an end wall 34 that is integrally connected to the lower wall 15 of the housing 11. The arrangement is such that the cam follower 22 translates in the housing 11 in a rectilinear movement in the manner of a piston. The movement of the cam follower 22, and therefore the first pair of magnets 28, is relative to the fixed magnetic housing 30.

Figure 2:
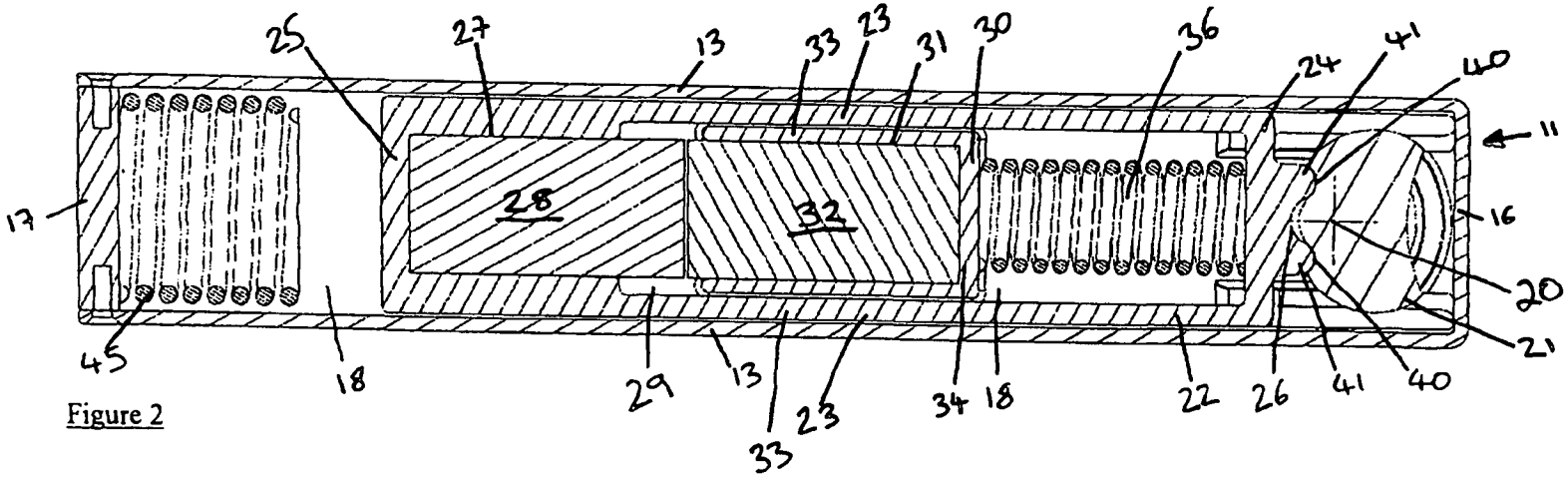
FIG. 2 is a sectioned view through a door closer in accordance with the present invention shown in a first configuration.
Figure 3:
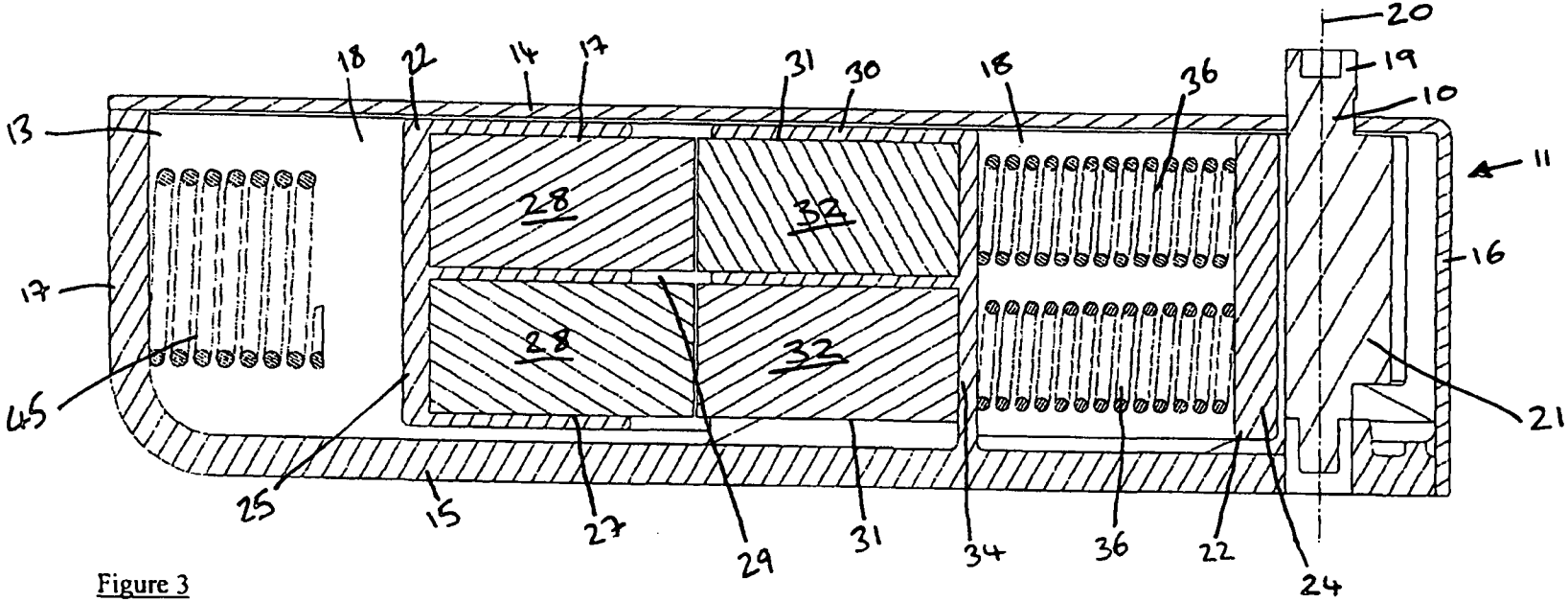
FIG. 3 is a sectioned view along line A-A of FIG. 2.

The first and second pairs of magnets 28, 32 are arranged such that their opposite poles face each other and the magnetic attraction draws them together thus biasing the cam follower 22 to the right in the orientation shown in FIGS. 2 and 3. The cam follower 22 is thus biased into engagement with the cam 21.

The cam follower 22 is also biased into engagement with the cam 21 by means of a pair of compression springs 36 that are disposed in vertical array in the inner chamber 29 between the second end wall 25 of the follower 22 and the fixed end wall 34 of the magnet housing 30. In this position of the door closer, as shown in FIGS. 2 and 3, the door would be biased by the closer to the closed position.

Figure 4:
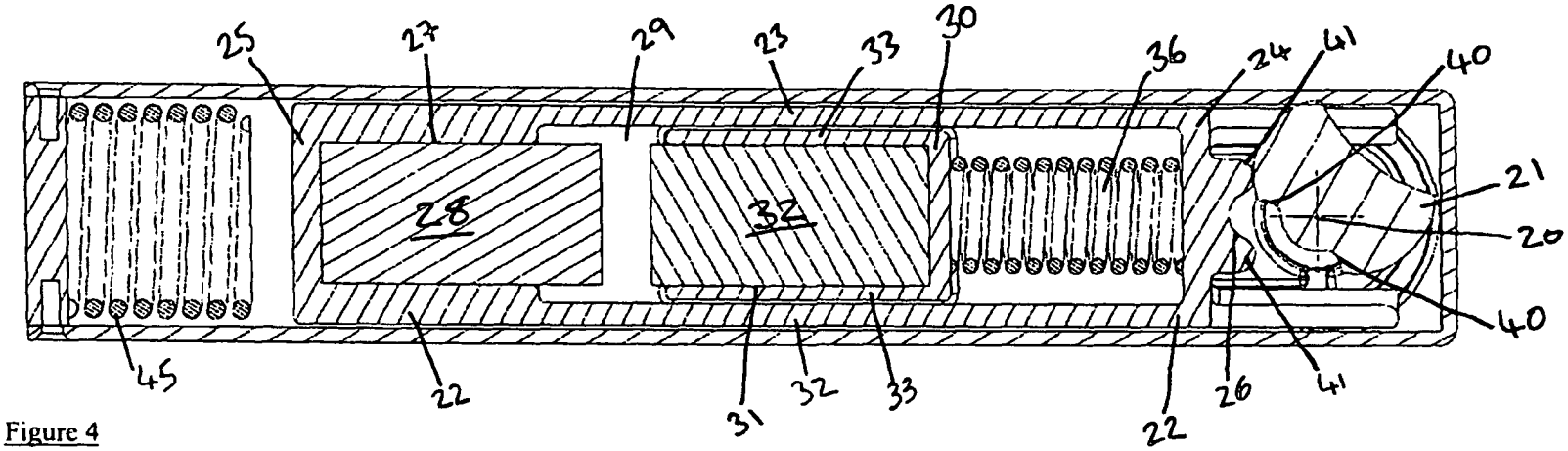
FIG. 4 is a sectioned view corresponding to that of FIG. 2 but shown in a second configuration.
Figure 5:
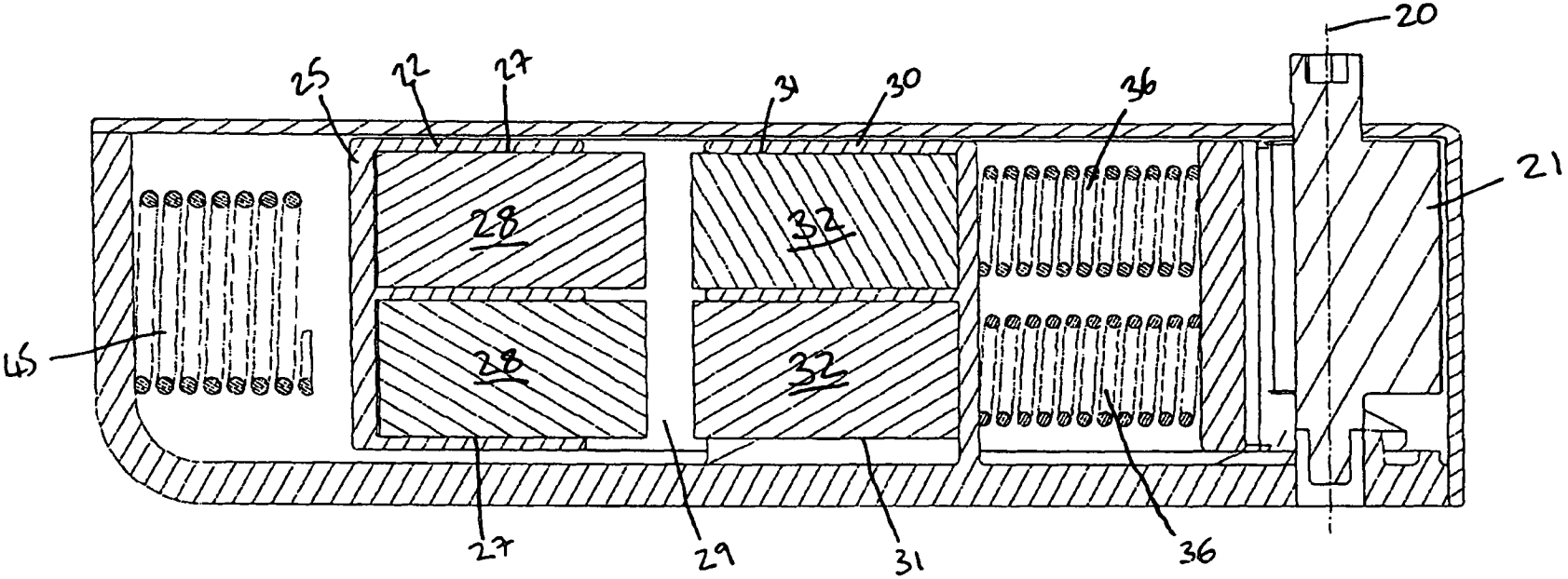
FIG. 5 is a sectioned view along line B-B of FIG. 4.

The eccentric cam 21 has a pair of elongate indentations 40 that extend substantially in parallel to its rotational axis 20 and which are designed to receive complementary ribs 41 defined on facing surface of the first end wall 24. Rotation of the cam 21 from the position shown in FIGS. 2 and 3 moves the indentations and ribs out of register and the eccentric form of the cam 21 moves the cam follower 22 to the left, as shown in FIGS. 4 and 5. In order for this movement to occur, the magnetic attraction of the magnet pairs 28, 32 has to be overcome by the application of sufficient torque to the drive spindle 10. This is achieved by the application of sufficient force to the door to move it from the closed position. As soon as this force is removed the closer will be biased back to the position shown in FIGS. 2 and 3 as will be explained in more detail below. It will be appreciated that the interfacing surfaces of the cam 21 and the end wall 24 may have a low friction coating or may incorporate bearing features such as, for example, rollers.

Figure 6:
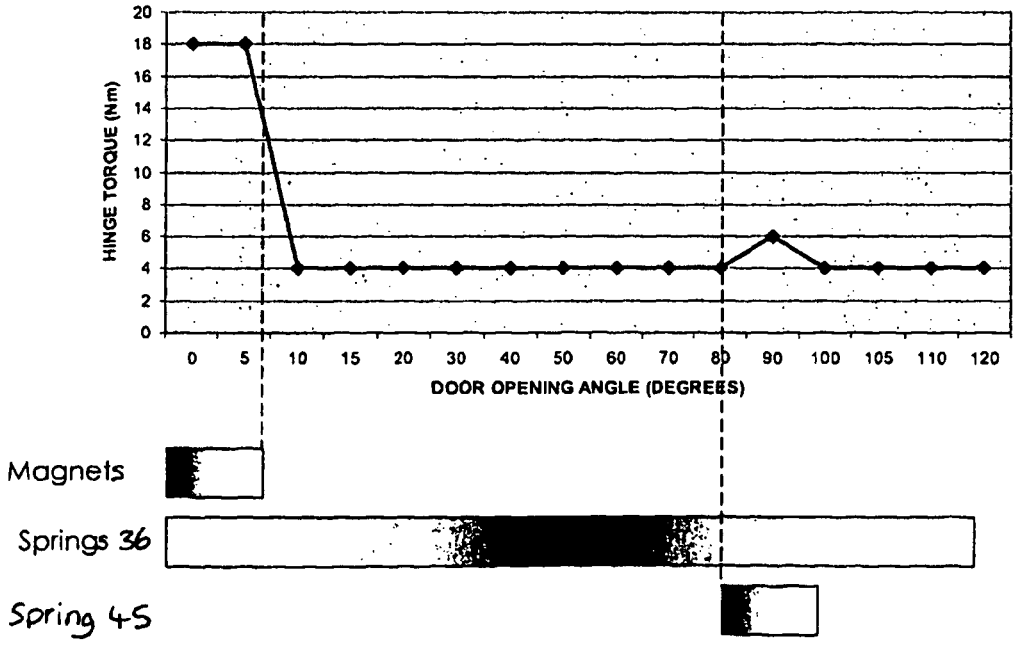
FIG. 6 is an graph illustrating an exemplary force profile for opening and closing of the door using the door closer of the present invention.

FIG. 6 is a graph plotting the torque (y-axis) at the door hinge against the door opening angle (x-axis) and illustrates a desirable force profile that is emulated approximately using the door closer of FIGS. 2 to 5. The initial force required to move the door from its closed position is relatively high as the magnetic attraction forces have to be surmounted to separate the magnet pairs 28, 32 and allow movement of the cam follower 22. As this is happening the springs 36 are compressed and offer a resistance which is initially significantly lower than the force of magnetic attraction. After the door has opened a small angle (around 9° or so in the example of FIG. 6) and the cam follower 22 has travelled a short distance sufficient to separate the magnet pairs 28, 32, the force of attraction diminishes significantly and the force required to rotate the drive spindle 10 further is dominated by that required to compress the springs 36 further by moving the cam follower 22 further to the left. This position is shown in FIGS. 4 and 5 where it can be seen that cam follower 22 has moved relative to the fixed magnet housing 30 into a position where the magnet pairs 28, 32 are separated and the springs 36 are compressed. Further rotation of the spindle 10, and therefore the cam 21, effects further movement of the cam follower 22 to a position where it encounters a secondary spring 45 disposed between the end wall 17 of the housing 11 and the first end wall 25 of the cam follower 22. The spring 45 provides a relatively low force resisting movement of the cam follower 22 towards the end of the opening movement of the door (the force increasing in the range 80° to 90° in the example provided in FIG. 6). This provides a detent sensation for the door user.

When the force opening the door is released, if the door has been opened fully, the secondary compression spring 45 first biases the cam follower 22 to the right and then the primary springs 36 take over to bias the cam follower further in the same direction until the spacing between the magnet pairs 28, 32 is reduced to a distance where the magnetic attraction force dominates. The movement of the cam follower 22 forces the eccentric cam 22 and therefore the spindle 10 to rotate in the opposite direction thus closing the door with a high closing torque at the end of its rotational travel.

The torque in the region where the biasing force of the springs 36 dominate is represented in the graph of FIG. 6 as constant, whereas the spring force represented is FIG. 1 increases. By suitable selection of a tightly wound compression spring and the profile of the eccentric cam the constant torque profile of FIG. 6 can be approximated.

Figure 7:
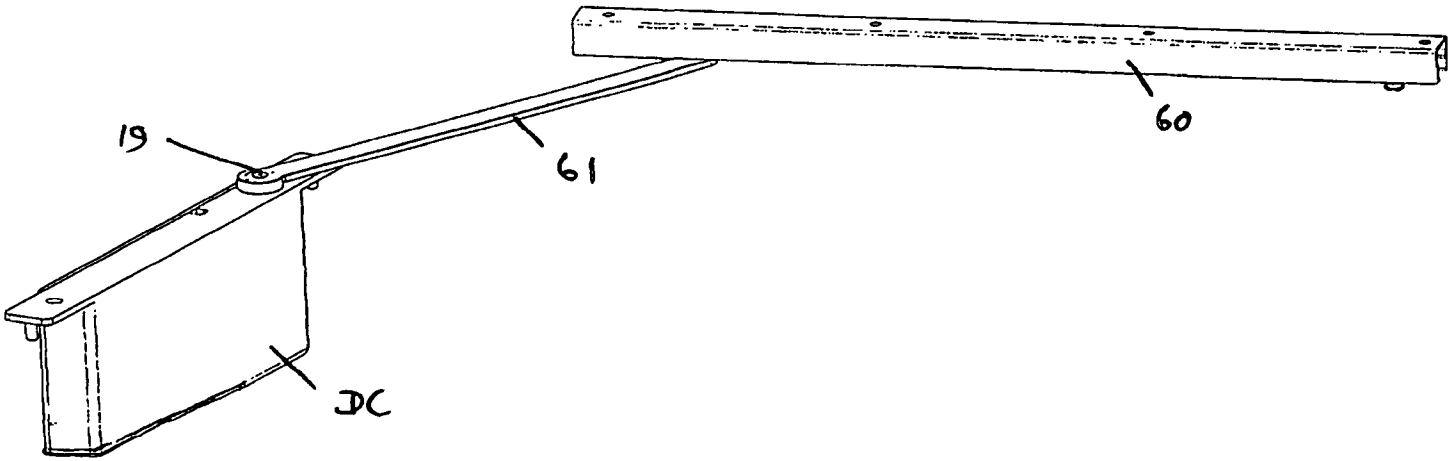
FIG. 7 is a perspective view of the door closer of FIGS. 2 to 5 connected to an arm and a guide track.

FIG. 7 shows the door closer DC connected to a track 60 by an arm 61. A first end of the arm is connected to the end 19 of the drive spindle 10 and the opposite end is engaged in the track by a suitable roller bearing or the like so as to slide along a channel defined by the track 60. The door closer DC may be fitted in or on the door with the track 60 mounted on the door frame. As the door rotates relative to the door frame the spindle 10 and arm 61 rotates and the opposite end of the arm slides in track.

Door closer mechanisms are traditionally immersed in oil in order to dampen the opening and closing movement of the door. This can be used in the present invention. As in existing door closer designs, oil may be transferred from one cavity to another cavity whilst the cam follower (imitating the action of a piston) moves. A variable size throttle between the cavities is used to control the rate of flow and therefore the speed of travel of the cam follower piston and the door.

It is to be appreciated that the magnets may all be permanent magnets or the pairs that attract one another may comprise a permanent magnet and a magnetic material that defines a pole piece for attraction to the permanent magnet, such a material may be for example, a soft iron or steel.

It will be appreciated that numerous modifications to the above described design may be made without departing from the scope of the invention as defined in the appended claims. For example, the precise number, positioning and shape of the magnets may be varied depending on the circumstances and the forces desired. Moreover, the resistance force applied by the spring 45 may also be achieved using magnets to repel the movement of the cam follower 22 at the end of its stroke.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A door closer configured to be fitted to a door or door frame, the door closer comprising a housing and a spindle disposed in and extending from the housing to enable connection between the door and the door frame, the spindle being disposed for rotation about an axis relative to the housing as the door moves between open and closed positions, at least one first magnet means coupled to the spindle by a piston and cam arrangement, the piston being reciprocally disposed in the housing and the cam being positioned between the piston and the spindle, at least one second magnetic means connected to the housing, the at least one first and second magnetic means arranged in the housing with their opposite poles facing one another such that there is a magnetic force of attraction between them, whereby relative movement of the housing and the spindle effects relative movement of the at least one first and second magnetic means between proximal and distal positions, the at least one first and second magnetic means being biased to the proximal position by the magnetic force of attraction, at least one of the first and second magnetic means being a permanent magnet.

2. A door closer according to claim 1, wherein the cam spindle includes the cam and the and rotates therewith about the axis, the rotation of the spindle and the cam effecting reciprocal travel of the piston.

3. A door closer according to claim 1, wherein the at least one first magnetic means is supported by the piston such that it reciprocates therewith.

4. A door closer according to claim 1, wherein the piston defines an opening in which at least the one second magnetic means is received, and wherein the piston is arranged to reciprocate such that the at least one first magnet means moves relative to the at least one second magnetic means.

5. A door closer according to claim 1, wherein there is provided at least one first biasing member for further biasing the at least one first and second magnetic means towards the proximal position.

6. A door closer according to claim 1, further comprising at least one first biasing member for further biasing the at least one first and second magnetic means towards the proximal position, the biasing member being arranged to further bias the piston towards the cam.

7. A door closer according to claim 6, the at least one biasing member acting between a fixed wall of the housing and the piston.

8. A door closer according to claim 6, further comprising at least one second biasing member that applies a biasing force to the piston when the at least one first and second magnetic means approach the distal position.

9. A door closer according to claim 1, wherein the at least one second magnetic means is received in a magnet housing that is fixed relative to the housing of the door closer.

* * * * *